US008935159B2

(12) United States Patent
Park et al.

(10) Patent No.: US 8,935,159 B2
(45) Date of Patent: Jan. 13, 2015

(54) NOISE REMOVING SYSTEM IN VOICE COMMUNICATION, APPARATUS AND METHOD THEREOF

(71) Applicants: Seong-Soo Park, Seoul (KR); Seong Il Jeong, Ansan-si (KR); Dong Gyung Ha, Seoul (KR); Jae Hoon Song, Seoul (KR)

(72) Inventors: Seong-Soo Park, Seoul (KR); Seong Il Jeong, Ansan-si (KR); Dong Gyung Ha, Seoul (KR); Jae Hoon Song, Seoul (KR)

(73) Assignees: SK Telecom Co., Ltd, Seoul (KR); Transono Inc., Seoul (KR)

( * ) Notice: Subject to any disclaimer, the term of this patent is extended or adjusted under 35 U.S.C. 154(b) by 0 days.

(21) Appl. No.: 13/864,935

(22) Filed: Apr. 17, 2013

(65) Prior Publication Data

US 2013/0226573 A1 Aug. 29, 2013

Related U.S. Application Data

(63) Continuation of application No. PCT/KR2011/007762, filed on Oct. 18, 2011.

(30) Foreign Application Priority Data

Oct. 18, 2010 (KR) ..... 10-2010-0101372

(51) Int. Cl.
*G10L 21/00* (2013.01)
*G10L 21/0208* (2013.01)

(52) U.S. Cl.
CPC ..... *G10L 21/0208* (2013.01)
USPC ..... 704/226; 704/227; 704/228; 704/233

(58) Field of Classification Search
USPC ..... 704/226–228, 233
See application file for complete search history.

(56) References Cited

U.S. PATENT DOCUMENTS

| | | | | |
|---|---|---|---|---|
| 7,295,972 | B2 * | 11/2007 | Choi | 704/226 |
| 8,046,218 | B2 * | 10/2011 | Allen et al. | 704/233 |
| 2005/0143989 | A1 * | 6/2005 | Jelinek | 704/226 |
| 2006/0053005 | A1 * | 3/2006 | Gulati | 704/226 |
| 2011/0029310 | A1 * | 2/2011 | Jung et al. | 704/233 |

(Continued)

FOREIGN PATENT DOCUMENTS

| | | |
|---|---|---|
| JP | 2006003899 | 1/2006 |
| JP | 2010102199 | 5/2010 |
| KR | 20090104557 | 10/2009 |

(Continued)

OTHER PUBLICATIONS

International Search Report mailed May 29, 2012 for PCT/KR2011/007762, citing the above reference(s).
Korean Notice of Allowance dated Aug. 6, 2012 for 10-2010-0101372, citing the above reference(s).

*Primary Examiner* — Douglas Godbold
(74) *Attorney, Agent, or Firm* — Lowe Hauptman & Ham, LLP

(57) ABSTRACT

Disclosed is the system and method to remove noises in voice signals in a voice communication. The at least one embodiment of the present disclosure performs a spectral subtraction (SS) for voice signals based on a gain function by a spectral subtraction apparatus, performs clustering of voice signals consecutive on a frequency axis of a spectrogram for the voice signals in which the spectral subtraction has been already performed to designate one or more clusters, and extracts musical noises by determining continuity of each of the designated clusters on the frequency axis and a time axis of the spectrogram to extract musical noises.

17 Claims, 5 Drawing Sheets

(56) References Cited

U.S. PATENT DOCUMENTS

| | | | | |
|---|---|---|---|---|
| 2011/0153321 | A1* | 6/2011 | Allen et al. | 704/226 |
| 2012/0239392 | A1* | 9/2012 | Mauger et al. | 704/226 |

FOREIGN PATENT DOCUMENTS

| | | |
|---|---|---|
| WO | 2005064595 | 7/2005 |
| WO | 2009123387 | 10/2009 |

* cited by examiner

NOISE REMOVING SYSTEM IN VOICE COMMUNICATION, APPARATUS AND METHOD THEREOF

CROSS-REFERENCE TO RELATED APPLICATION

The present application is a continuation of International Application No. PCT/KR2011/007762 filed on Oct. 18, 2011, which is based on, and claims priority from, KR Application Serial Number 10-2010-0101372, filed on Oct. 18, 2010. The disclosures of the above-listed applications are hereby incorporated by reference herein in their entirety.

FIELD

The disclosure relates to technology for removing noises of a voice signal in a voice communication.

BACKGROUND

The statements in this section merely provide background information related to the present disclosure and may not constitute prior art.

In real life, background noise contaminates pure voice and degrades the performance and capabilities of voice communication systems such as mobile phones, voice recognition, voice coding, speaker recognition and the like. Accordingly, research on sound quality improvement to reduce noise effects and enhance system capabilities has progressed over time, and the importance thereof currently receives a lot of attention.

Meanwhile, a Spectral Subtraction (SS) is a typical method widely used in a single channel due to its low cost and easy implementation among various sound quality improving methods. The inventors have noted that in the spectral subtraction there might remain musical noise corresponding to a new artifact sound in the voice signals even after the spectral subtraction.

The musical noise refers to a random frequency component generated by evaluating estimated noise as being lower than original noise, and furthermore refers to a tone which perceivedly annoys a listener since residue of the musical noise on time and frequency axes in a spectrogram is discontinuously spread.

In this connection, in order to suppress the residue of the musical noise, the spectral subtraction method based on a gain function has been proposed.

For example, there are "wiener filtering", "nonlinear spectral subtraction with oversubtraction factor and spectral floor", "minimum mean square error short-time spectral amplitude estimation or log spectral amplitude", "oversubtraction based on masking properties of human auditory system", and "soft decision estimation, maximum likelihood, signal subspace". The inventors have noted that most of the proposed methods might not be able to efficiently improve sound quality in a noise environment having a low Signal to Noise Ratio (SNR).

In other words, the inventors have noted that when noise estimated to be larger than the actual noise and an over-evaluated gain function are used, the residue and divergence of the musical noise are reduced, but voice distortion increases. The inventors have noted that, inversely, when noise estimated to be lower than the actual noise and an under-evaluated gain function are used, voice distortion is reduced but the residue and divergence of the musical noise increases.

SUMMARY

In accordance with some embodiments, the noise removing system in a voice communication comprises a spectral subtraction apparatus and a noise removing apparatus. The spectral subtraction apparatus is configured to perform a spectral subtraction (SS) for voice signals based on a gain function. And the noise removing apparatus is configured to perform clustering of the voice signals, for which the spectral subtraction has been performed and which are consecutive on a frequency axis of a spectrogram, to designate one or more clusters, and configured to determine continuity of each of the designated clusters on a frequency axis and a time axis to extract musical noises.

In accordance with some embodiments, the noise removing apparatus comprises a clustering unit, a first extractor and a second extractor. The clustering unit is configured to perform clustering of voice signals on a frequency axis of a spectrogram to designate one or more clusters. The first extractor configured to determine continuity of each of the designated clusters on the frequency axis to extract clusters corresponding to musical noises. And the second extractor configured to extract clusters corresponding to the musical noises based on similarities among clusters for each of residual clusters.

In accordance with some embodiments, the noise removing apparatus is configured to perform removing noises from voice signals in a voice communication. The noise removing apparatus is configured to perform clustering of voice signals on a frequency axis of a spectrogram, the voice signals for which a spectral subtraction based on a gain function has been performed to designate one or more clusters, to firstly extract clusters corresponding to musical noises by determining continuity of each of designated clusters on the frequency axis, and to secondly extracting clusters corresponding to other musical noises based on similarities among clusters for each of residual clusters.

BRIEF DESCRIPTION OF THE DRAWINGS

The above and other objects, features and advantages of the present disclosure will be more apparent from the following detailed description taken in conjunction with the accompanying drawings, in which.

DETAILED DESCRIPTION

The at least one embodiment of the present disclosure is to extract musical noises through characteristics belonging to the voice and musical noise by providing a voice communication based-noise removing system and method which performs a spectral subtraction (SS) for voice signals based on a gain function by a spectral subtraction apparatus; performs clustering of voice signals consecutive on a frequency axis of a spectrogram for the voice signals in which the spectral subtraction has been already performed to designate one or more clusters, and extracts musical noises by determining continuity on a frequency axis and a time axis of each of the designated clusters to extract musical noises using a noise removing apparatus.

Hereinafter, exemplary embodiments of the present disclosure will be described with reference to the accompanying drawings.

Figure 1:
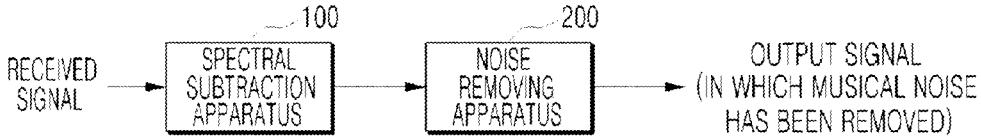
FIG. 1 is a schematic block diagram of a voice communication based-noise removing system according to at least one embodiment.

FIG. 1 is a schematic block diagram of a voice communication based-noise removing system according to at least one embodiment.

As illustrated in FIG. 1, the system comprise a spectral subtraction apparatus 100 configured to perform a Spectral Subtraction (SS) for a voice signal to which a noise is added, and a noise removing apparatus 200 configured to thereafter perform clustering for the voice signal which already performing the spectral subtraction for and to extract musical noise from the voice signal based on the clustering. Here, the voice signal refers to a received signal in a voice communication environment where background noise flows in and pure voice may be contaminated in real life, and may be used in various fields, for example, a mobile phone, voice recognition, voice coding, speaker recognition and the like. That is, the voice signal refers to not a pure voice signal but background noise added voice signal.

The spectral subtraction apparatus 100 is configured to perform a spectral subtraction based on a gain function for the voice signal received in the voice communication environment to improve sound quality, and a spectral subtraction operation of the spectral subtraction apparatus 100 will be described below through equation (1) to equation (4).

That is, contaminated voice x(n) generated by contaminating a pure voice signal s(n) with additive noise w(n) is expressed by equation (1) below.

$$x(n)=s(n)+w(n) \tag{1}$$

In equation (1), n denotes a discrete time index, and x(n) may approximate to a Fourier Spectrum (FS) $X_i(f)$ by a Fourier transform as shown in equation (2).

$$X_i(f)=S_i(f)+W_i(f) \tag{2}$$

In equation (2), i and f denote indexes in a frame and a frequency position (bin), respectively, $S_i(f)$ denotes FS of the pure voice, and $W_i(f)$ denotes FS of the additive noise.

In this connection, the spectral subtraction method based on the gain function $G_i(f)$ including an oversubtraction element $\alpha(\alpha\geq 1)$, which is introduced to suppress the residue of the musical noise is as defined in equation (3) and equation (4).

$$G_i(f)=\begin{cases}\left(1-\alpha\left|\frac{\hat{W}_i(f)}{X_i(f)}\right|^r\right)^{1/r}, & \text{if } \frac{|\hat{W}_i(f)|^r}{|X_i(f)|}<\frac{1}{\alpha+\beta}\\ \left(\beta\left|\frac{\hat{W}_i(f)}{X_i(f)}\right|^r\right)^{1/r}, & \text{otherwise}\end{cases} \tag{3}$$

$$\hat{S}_i(f)=X_iG_i(f) \tag{4}$$

In equations (3) and (4), $|X_i(f)|$ and $|\hat{W}(f)|$ denote a Fourier Magnitude Spectrum (FMS) of $X_i(f)$ and a FMS of estimated noise, respectively. Further, $\alpha$ is a factor which increases voice distortion while reducing a peak element of the residual noise by subtracting more noise than estimated. Furthermore, $\beta(0\leq\beta<1)$ denotes a spectral smoothing element for masking the residual noise, and a value approximated to "0" is generally used. In addition, r denotes an exponent for determining a shape of subtraction bending.

Figure 2:
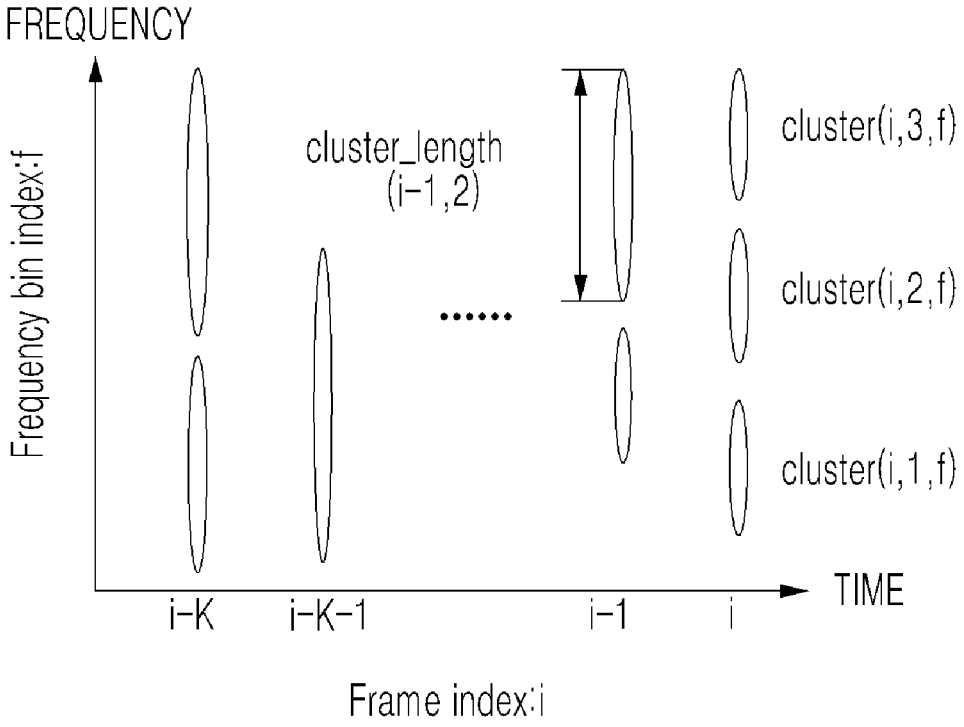
FIG. 2 is a exemplary spectrogram according to at least one embodiment.

The noise removing apparatus 200 is configured to perform clustering on a frequency axis of a spectrogram in order to remove musical noise which may remain in a voice signal in which the spectral subtraction has been performed by the spectral subtraction apparatus 100. More specifically, the noise removing apparatus 200 is configured to perform the clustering for signals consecutive on the frequency axis of the spectrogram as illustrated in FIG. 2 to designate one or more clusters {cluster(i,j,f)}, and determines a residual signal on the spectrogram except for the designated clusters as noise to remove the residual signal. Here, the cluster {cluster(i,j,f)} refers to the unit for determining a voice or musical noise group, and i, j, and f refer to a frame, a cluster, and a frequency index, respectively.

Based on the above description, the noise removing apparatus 200 is configured to determine continuity of each cluster on the frequency axis to thereafter extract the cluster corresponding to musical noise. More specifically, the noise removing apparatus 200 is configured to compare each designated cluster length {cluster_length(i,j)}, that is, a continuous length of each cluster on the frequency axis with a set threshold to thereafter extract and remove the cluster corresponding to the musical noise. To this end, the noise removing apparatus 200 is configured to designate each of frames distinguished according to the time axis of the spectrogram as a noise-like frame or a voice-like frame through a pre-designated voice section extraction scheme, for example, a voice activity detector. Further, the noise removing apparatus 200 is configured to compare a length of each cluster located on the designated noise-like frame or voice-like frame with a preset threshold to determine whether there is musical noise corresponding to each cluster. That is, when the cluster length {cluster_length(i,j)} is smaller than a first threshold (TH1) in the noise-like frame, the noise removing apparatus 200 is configured to distinguish the corresponding cluster as musical noise and extract the cluster. Further, when the cluster length {cluster_length(i,j)} is smaller than a second threshold (TH2) in the voice-like frame, the noise removing apparatus 200 distinguishes the corresponding cluster as musical noise and extracts the cluster. For reference, the second threshold (TH2) has a larger value than that of the first threshold (TH1).

Figure 3:
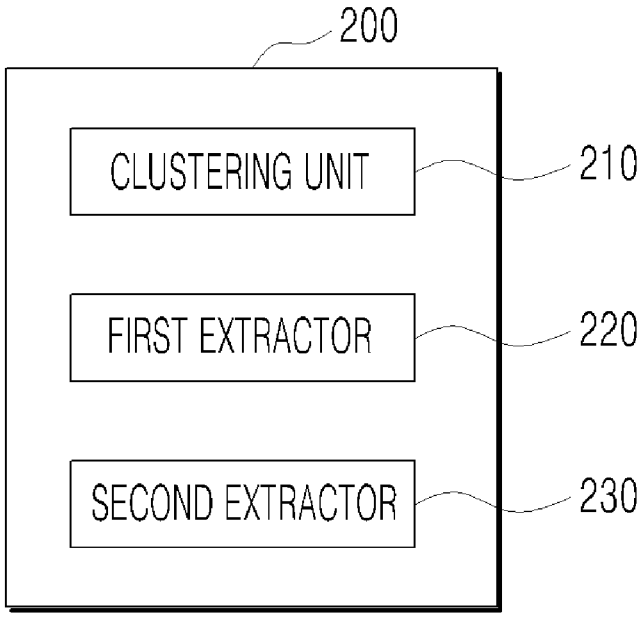
FIG. 3 is a schematic block diagram of a noise removing apparatus according to at least one embodiment.

Further, with respect to each of the residual clusters, the noise removing apparatus 200 extracts the cluster corresponding to the musical noise based on similarities between clusters More specifically, with respect to each of the residual clusters, the noise removing apparatus 200 may output a voice signal in which the musical noise has been removed by determining similarities based on an average or deviation of cluster lengths and extracting the cluster corresponding to the musical noise. That is, as illustrated in FIG. 2, when signals are not consecutive on the time axis from the cluster (i−k, ,f) to the cluster (i, ,f), the noise removing apparatus 200 is configured to distinguish the cluster (i, ,f) as musical noise and extract the cluster (i, ,f) by using characteristics that the voice is consecutive on the time axis but the musical noise is not consecutive on the time axis. Here, k denotes a past frame constant. Further, the noise removing apparatus 200 may extract the cluster (i, ,f) as musical noise by comparing an average or deviation from cluster (i−k, ,f) to cluster (i, ,f) on the time axis with cluster (i, ,f) to determine an acquired similarity degree by using characteristics that an average or deviation of the voice is larger than that of the musical noise. The spectral subtraction apparatus 100 and/or the noise removing apparatus 200 include(s) one or more network interfaces, which can communicate to each other and various networks including, but not limited to, cellular, Wi-Fi, LAN, WAN, CDMA, WCDMA, GSM, LTE and EPC networks, and cloud computing networks. The spectral subtraction apparatus 100 and/or the noise removing apparatus 200 is/are implemented by one or more processors and/or application-specific integrated circuits (ASICs) as describe herein Hereinafter, a detailed configuration of the noise removing apparatus 200 according to at least one embodiment will be described with reference to FIG. 3.

That is, the noise removing apparatus 200 is configured to comprise a clustering unit 210 configured to perform clustering for a voice signal, a first extractor 220 configured to extract musical noise based on the frequency axis, and a second extractor 230 configured to extract musical noise based on the time axis.

The clustering unit 210 is configured to perform clustering between voice signals in which the Spectral Subtraction (SS) based on the gain function has been performed on the frequency axis of the spectrogram and designate one or more clusters. More specifically, the clustering unit 210 is configured to perform clustering for signals consecutive on the frequency axis of the spectrogram as illustrated in FIG. 2 to designate one or more clusters {cluster(i,j,f)}, and determine residual signals on the spectrogram except for the designated clusters as the noise to remove the determined residual signals. Here, cluster {cluster(i,j,f)} refers to the unit for determining a voice or musical noise group, and i, j, and f refer to a frame, a cluster, and a frequency index, respectively.

The first extractor 220 is configured to determine continuity of the designated cluster on the frequency axis to extract the cluster corresponding to the musical noise. More specifically, the first extractor 220 is configured to compare the designated cluster length {cluster_length(i,j)}, that is, a continuous length of each cluster on the frequency axis with a set threshold to thereafter extract and remove the cluster corresponding to the musical noise. To this end, the first extractor 220 is configured to designate each of frames distinguished according to the time axis of the spectrogram as a noise-like frame or a voice-like frame through a pre-designated voice section extraction scheme, for example, a voice activity detector. Further, the first extractor 220 is configured to compare a length of each cluster located on the designated noise-like frame or voice-like frame with a preset threshold to determine whether there is musical noise corresponding to each cluster. That is, when the cluster length {cluster_length (i,j)} is smaller than a first threshold (TH1) in the noise-like frame, the first extractor 220 is configured to distinguish the corresponding cluster as musical noise and thereafter extract the cluster as illustrated in FIG. 2. Further, when the cluster length {cluster_length(i,j)} is smaller than a second threshold (TH2) in the voice-like frame, the first extractor 220 is configured to distinguish the corresponding cluster as musical noise and thereafter extract the cluster. For reference, the second threshold (TH2) has a larger value than that of the first threshold (TH1).

With respect to each of the residual clusters, the second extractor 230 is configured to extract the cluster corresponding to the musical noise based on similarities between clusters. More specifically, with respect to each of the residual clusters, the second extractor 230 may output a voice signal in which the musical noise has been removed, by determining similarities based on an average or deviation of cluster lengths and extracting the cluster corresponding to the musical noise. That is, as illustrated in FIG. 2, when signals are not consecutive on the time axis from cluster (i−k, ,f) to cluster (i, ,f), the second extractor 230 is configured to distinguish cluster (i, ,f) as the musical noise and extract cluster (i, ,f) by using characteristics that the voice is consecutive on the time axis but the musical noise is not consecutive on the time axis. Here, k denotes a past frame constant. Further, the second extractor 230 may extract cluster (i, ,f) as the musical noise by comparing an average or deviation from cluster (i−k, ,f) to cluster (i, ,f) on the time axis with cluster (i, ,f) to determine an acquired similarity degree by using characteristics that an average or deviation of the voice is larger than that of the musical noise.

As described above, according to the voice communication based-noise removing system, it is possible to extract the residue of the musical noise from the noise area and thus provide a natural listening effect by performing the clustering corresponding to the task of grouping signals in which the Spectral Subtraction (SS) for removing the noise from voice communication has been performed on the frequency axis of the spectrogram displaying a difference in amplitudes according to a change in the time and frequency axes and extracting only the musical noise through characteristics belonging to the voice and musical noise based on the clustering. Further, since the voice distortion generated in the voice area is prevented, reliability of speech intelligibility can be guaranteed. In addition, since the musical noise is extracted from the voice area, divergence of the noise can be reduced. Other components of the noise removing apparatus 200, such as the clustering unit 210, the first extractor 220, and the second extractor 230, are implemented by one or more processors and/or application-specific integrated circuits (ASICs) as describe herein.

Figure 4:
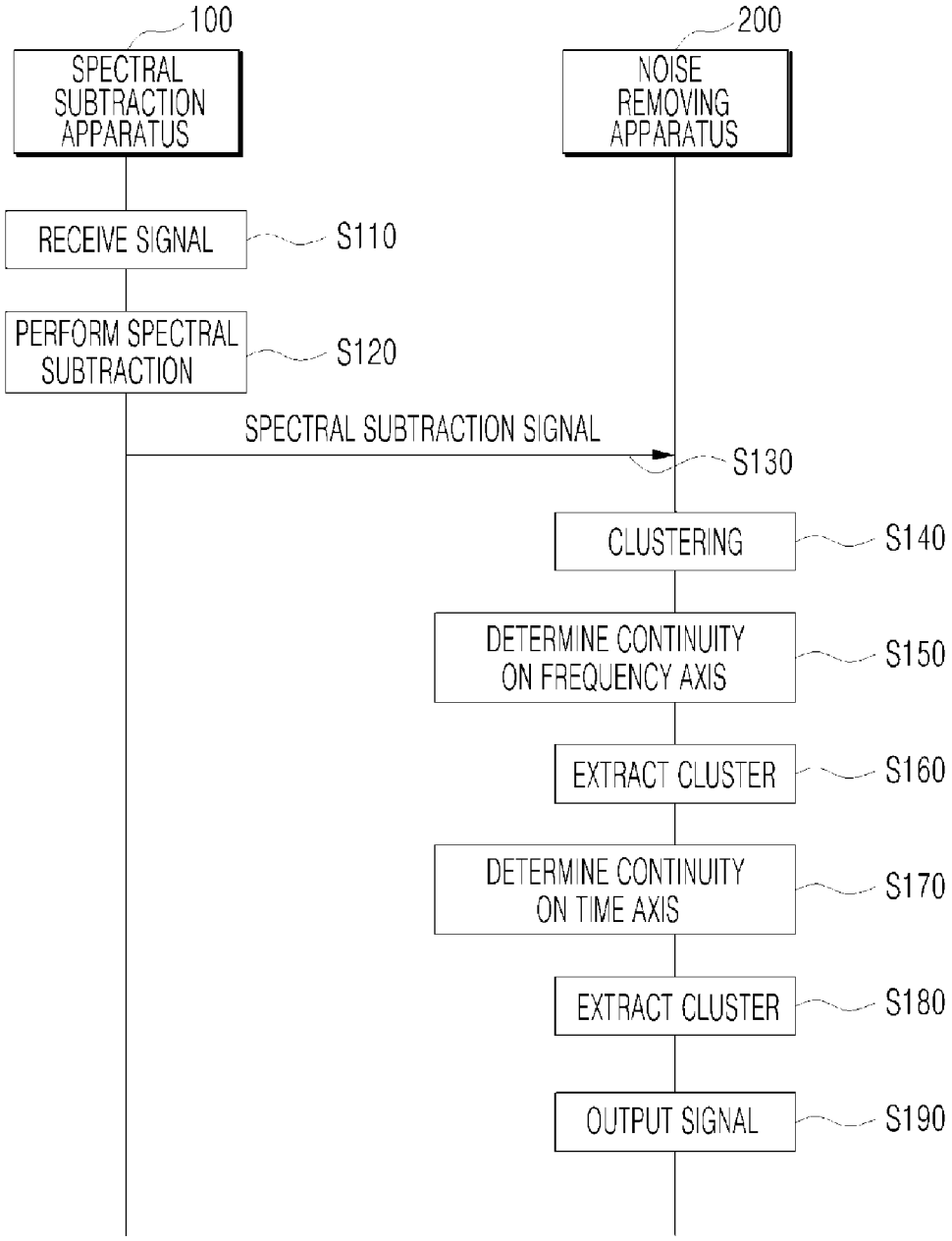
FIGS. 4 and 5 are flowcharts of various voice communication based-noise removing methods according to at least one embodiment.
Figure 5:
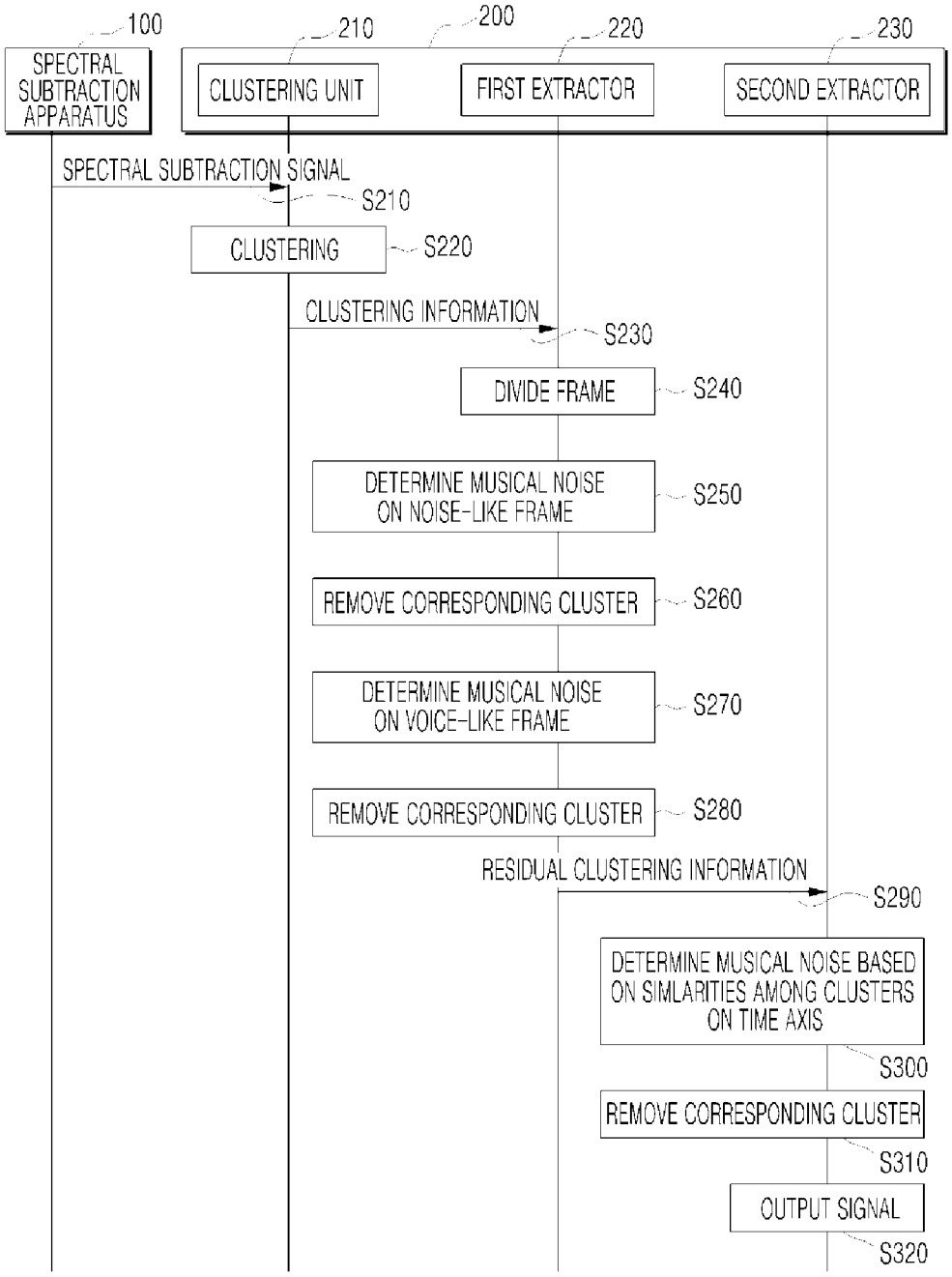

Hereinafter, a voice communication based-noise removing method according to at least one embodiment will be described with reference to FIGS. 4 and 5. Here, the configurations illustrated in FIGS. 4 and 5 which have been described through FIGS. 1 to 3 will be discussed by using corresponding reference numerals for the convenience of the description.

First, a method of driving the voice communication based-noise removing system according to an embodiment of the present disclosure will be described with reference to FIG. 4.

The spectral subtraction apparatus 100 is configured to perform the spectral subtraction based on the gain function for a voice signal, to which a noise is added, received in a voice communication environment to improve sound quality in steps S110 to S130. The spectral subtraction operation of the spectral subtraction apparatus 100 may be described through equation (1) to equation (4).

That is, contaminated voice x(n) generated by contaminating a pure voice signal s(n) with additive noise w(n) is expressed by equation (1) below.

$$x(n)=s(n)+w(n) \tag{1}$$

In equation (1), n denotes a discrete time index, and x(n) may approximate to Fourier Spectrum (FS) $X_i(f)$ by a Fourier transform as shown in equation (2).

$$X_i(f)=S_i(f)+W_i(f) \tag{2}$$

In equation (2), i and f denote indexes in a frame and a frequency position (bin), respectively, $S_i(f)$ denotes FS of the pure voice, and $W_i(f)$ denotes FS of the noise.

In this connection, the spectral subtraction method based on the gain function $G_i(f)$ including an oversubtraction element $\alpha(\alpha\geq 1)$, which is introduced to suppress the residue of the musical noise is as defined in equation (3) and equation (4)

$$G_i(f) = \begin{cases} \left(1 - \alpha\left|\frac{\hat{W}_i(f)}{X_i(f)}\right|^r\right)^{1/r}, & \text{if } \frac{|\hat{W}_i(f)|^r}{|X_i(f)|} < \frac{1}{\alpha+\beta} \\ \left(\beta\left|\frac{\hat{W}_i(f)}{X_i(f)}\right|^r\right)^{1/r}, & \text{otherwise} \end{cases} \quad (3)$$

$$\hat{S}_i(f) = X_i G_i(f) \quad (4)$$

In equations (3) and (4), $|X_i(f)|$ and $|\hat{W}(f)|$ denote a Fourier Magnitude Spectrum (FMS) of $X_i(f)$ and a FMS of estimated noise, respectively. Further, $\alpha$ is a factor which increases voice distortion while reducing a peak element of the residual noise by subtracting more noise than estimated. Furthermore, $\beta(0 \leq \beta < 1)$ denotes a spectral smoothing element for masking the residual noise, and a value approximated to "0" is generally used. In addition, r denotes an exponent for determining a shape of subtraction bending.

Then, the noise removing apparatus 200 is configured to perform clustering on a frequency axis of a spectrogram in order to remove musical noise which may remain in a voice signal in which the spectral subtraction has been performed by the spectral subtraction apparatus 100 in step S140. More specifically, the noise removing apparatus 200 is configured to perform the clustering for signals consecutive on the frequency axis of the spectrogram as illustrated in FIG. 2 to designate one or more clusters {cluster(i,j,f)}, and distinguish (or detect) a residual signal on the spectrogram except for the designated clusters as noise to remove the residual signal. Here, cluster {cluster(i,j,f)} refers to the unit for determining a voice or musical noise group, and i, j, and f refer to a frame, a cluster, and a frequency index, respectively.

Then, the noise removing apparatus 200 is configured to determine the continuity of each cluster on the frequency axis to thereafter extract the cluster corresponding to musical noise in steps S150 to S160. More specifically, the noise removing apparatus 200 is configured to compare each designated cluster length {cluster_length(i,j)}, that is, a continuous length of each cluster on the frequency axis with a set threshold to extract the cluster corresponding to the musical noise. To this end, the noise removing apparatus 200 is configured to designate each of frames distinguished according to the time axis of the spectrogram as a noise-like frame or a voice-like frame through a pre-designated voice section extraction scheme, for example, a voice activity detector. Further, the noise removing apparatus 200 compares a length of each cluster located on the designated noise-like frame or voice-like frame with a preset threshold to determine whether there is musical noise corresponding to each cluster. That is, when the cluster length {cluster_length(i,j)} is smaller than a first threshold (TH1) in the noise-like frame, the noise removing apparatus 200 distinguishes the corresponding cluster as musical noise and extracts the cluster. Further, when the cluster length {cluster_length(i,j)} is smaller than a second threshold (TH2) in the voice-like frame, the noise removing apparatus 200 distinguishes the corresponding cluster as the musical noise and extracts the cluster. For reference, the second threshold (TH2) has a larger value than that of the first threshold (TH1).

Thereafter, with respect to each of the residual clusters, the noise removing apparatus 200 is configured to extract the cluster corresponding to the musical noise based on similarities between clusters in steps S170 to S190. In at least one embodiment, with respect to each of the residual clusters, the noise removing apparatus 200 may output a voice signal in which the musical noise has been removed, by determining similarity based on an average or deviation of cluster lengths and extracting the cluster corresponding to the musical noise. That is, as illustrated in FIG. 2, when signals are not consecutive on the time axis from cluster (i−k, ,f) to cluster (i, ,f), the noise removing apparatus 200 distinguishes cluster (i, ,f) as musical noise and extracts cluster (i, ,f) by using characteristics that the voice is consecutive on the time axis but the musical noise is not consecutive on the time axis. Here, k denotes a past frame constant. Further, the noise removing apparatus 200 may extract cluster (i, ,f) as the musical noise by comparing an average or deviation from cluster (i−k, ,f) to cluster (i, ,f) on the time axis with cluster (i, ,f) to determine an acquired similarity degree by using characteristics that an average or deviation of the voice is larger than that of the musical noise.

Hereinafter, a method of removing a noise in a voice signal by the noise removing apparatus 200 according to at least one embodiment will be described with reference to FIG. 5.

First, the clustering unit 210 is configured to perform clustering for signals consecutive on the frequency axis of the spectrogram as illustrated in FIG. 2 to designate one or more clusters {cluster(i,j,f)}, and determine residual signals on the spectrogram except for the designated clusters as the noise to remove the determined residual signals in steps S210 to S230. Here, cluster {cluster(i,j,f)} refers to the unit for determining a voice or musical noise group, and i, j, and f refer to a frame, a cluster, and a frequency index, respectively.

Then, the first extractor 220 is configured to designate each of frames distinguished according to the time axis of the spectrogram as a noise-like frame or a voice-like frame through a pre-designated voice section extraction scheme, for example, a voice activity detector in step S240.

When the cluster length {cluster_length(i,j)} is smaller than a first threshold (TH1) in the noise-like frame as illustrated in FIG. 2, the first extractor 220 distinguishes the corresponding cluster as musical noise and extracts the cluster in steps S250 to S260.

Further, when the cluster length {cluster_length(i,j)} is smaller than a second threshold (TH2) in the voice-like frame, the first extractor 220 distinguishes the corresponding cluster as musical noise and extracts the cluster in steps S270 to S280. For reference, the second threshold (TH2) has a larger value than that of the first threshold (TH1).

Thereafter, with respect to each of the residual clusters, the second extractor 230 is configured to output a voice signal in which the musical noise has been removed, by determining similarities based on an average or deviation of cluster lengths and extracting the cluster corresponding to the musical noise in steps S300 to S320. In the at least one embodiment, as illustrated in FIG. 2, when signals are not consecutive on the time axis from cluster (i−k, ,f) to cluster (i, ,f), the second extractor 230 distinguishes cluster (i, ,f) as musical noise and extracts cluster (i, ,f) by using characteristics that the voice is consecutive on the time axis but the musical noise is not consecutive on the time axis. Here, k denotes a past frame constant. Further, the second extractor 230 may extract cluster (i, ,f) as the musical noise by comparing an average or deviation from cluster (i−k, ,f) to cluster (i, ,f) on the time axis with cluster (i, ,f) to determine an acquired similarity degree by using characteristics that an average or deviation of the voice is larger than that of the musical noise.

As described above, according to the voice communication based-noise removing method, it is possible to extract the residue of the musical noise from the noise area and thus provide a natural listening effect by performing the clustering corresponding to the task of grouping signals in which the Spectral Subtraction (SS) for removing the noise from voice communication has been performed on the frequency axis of the spectrogram displaying a difference in amplitudes according to a change in the time and frequency axes and extracting only the musical noise through characteristics belonging to the voice and musical noise based on the clustering. Further, since the voice distortion generated in the voice area is prevented, reliability of speech intelligibility can be guaranteed. In addition, since the musical noise is extracted from the voice area, divergence of the noise can be reduced.

The various embodiments as described above may be implemented in the form of one or more program commands that can be read and executed by a variety of computer systems and be recorded in any non-transitory, a computer-readable recording medium. The computer-readable recording medium may include a program command, a data file, a data structure, etc. alone or in combination. The program commands written to the medium are designed or configured especially for the at least one embodiment, or known to those skilled in computer software. Examples of the computer-readable recording medium include magnetic media such as a hard disk, a floppy disk, and a magnetic tape, optical media such as a CD-ROM and a DVD, magneto-optical media such as an optical disk, and a hardware device configured especially to store and execute a program, such as a ROM, a RAM, and a flash memory. Examples of a program command include a premium language code executable by a computer using an interpreter as well as a machine language code made by a compiler. The hardware device may be configured to operate as one or more software modules to implement the present invention or vice versa. In some embodiments, one or more of the processes or functionality described herein is/are performed by specifically configured hardware (e.g., by one or more application specific integrated circuits or ASIC(s)). Some embodiments incorporate more than one of the described processes in a single ASIC. In some embodiments, one or more of the processes or functionality described herein is/are performed by at least one processor which is programmed for performing such processes or functionality.

While the present disclosure has been shown and described with reference to certain embodiments thereof, it will be understood by those skilled in the art that various changes in form and details may be made therein without departing from the subject matter, the spirit and scope of the present disclosure as defined by the appended claims. Specific terms used in this disclosure and drawings are used for illustrative purposes and not to be considered as limitations of the present disclosure.

What is claimed is:

1. A noise removing system in a voice communication, comprising:

a spectral subtraction apparatus configured to perform a spectral subtraction (SS) for voice signals; and a noise removing apparatus configured to perform clustering of the voice signals, for which the spectral subtraction has been performed and which are consecutive on a frequency axis of a spectrogram, to designate one or more clusters, and determine continuity of each of the designated clusters on the frequency axis and a time axis of the spectrogram to extract musical noises.

2. The system of claim 1, wherein the noise removing apparatus is configured to compare a continuous length of each of the designated clusters on the frequency axis with a threshold to extract, among the designated clusters, one or more first clusters corresponding to the musical noises, and extract, from residual clusters, one or more second clusters corresponding to the musical noises based on similarities among the residual clusters, wherein the residual clusters are the rest of the designated clusters after extracting said one or more first clusters.

3. A noise removing apparatus, comprising:

a clustering unit configured to perform clustering of voice signals on a frequency axis of a spectrogram to designate one or more clusters;

a first extractor configured to determine continuity of each of the designated clusters on the frequency axis, and extract, among the designated clusters, one or more first clusters corresponding to musical noises based on the determined continuity of said each of the designated clusters; and a second extractor configured to extract, from residual clusters, one or more second clusters corresponding to the musical noises based on similarities among the residual clusters, wherein the residual clusters are the rest of the designated clusters after extracting said one or more first clusters.

4. The apparatus of claim 3, wherein the clustering unit is configured to designate one or more clusters by performing the clustering among the voice signals consecutive on the frequency axis of the spectrogram.

5. The apparatus of claim 4, wherein the clustering unit is configured to remove residual signals on the spectrogram except for the designated clusters.

6. The apparatus of claim 3, wherein the first extractor is configured extract the clusters corresponding to the musical noises by comparing a continuous length of each of the designated clusters on the frequency axis with a threshold.

7. The apparatus of claim 6, wherein the first extractor is configured to designate each frame distinguished on the time axis of the spectrogram as a noise-like frame or a voice-like frame through a pre-designated voice section extraction scheme, and compare a length of each cluster located on the noise-like frame with a first threshold and a length of each cluster located on the voice-like frame with a second threshold.

8. The apparatus of claim 7, wherein the second threshold is larger than the first threshold.

9. The apparatus of claim 3, wherein the second extractor is configured to extract said one or more second clusters corresponding to the musical noises by determining the similarities based on an average or deviation of cluster lengths for each of the residual clusters.

10. A method of removing a noise, the method performed by a noise removing apparatus in a voice communication, the method comprising:

performing clustering of voice signals, for which a spectral subtraction based on a gain function has been performed, on a frequency axis of a spectrogram to designate one or more clusters;

first extracting, among the designated clusters, one or more first clusters corresponding to musical noises by determining continuity of each of the designated clusters on the frequency axis; and second extracting, from residual clusters, one or more second clusters corresponding to musical noises based on similarities among the residual clusters, wherein the residual clusters are the rest of the designated clusters after extracting said one or more first clusters.

11. The method of claim 10, wherein the performing of the clustering comprises performing the clustering between the voice signals consecutive on the frequency axis of the spectrogram to designate one or more clusters.

12. The method of claim 11, wherein the performing of the clustering comprises removing residual signals on the spectrogram except for the designated clusters.

13. The method of claim 10, wherein the first extracting comprises extracting the one or more first clusters corresponding to the musical noises by comparing a continuous length of each of the designated clusters on the frequency axis with a threshold.

14. The method of claim 13, wherein the first extracting comprises:

designating each frame distinguished on the time axis of the spectrogram as a noise-like frame or a voice-like frame through a pre-designated voice section extraction scheme; and comparing a length of each cluster located on the noise-like frame with a first threshold and a length of each cluster located on the voice-like frame with a second threshold.

15. The method of claim 14, wherein the comparing comprises when the length of the cluster located on the designated noise-like frame length is smaller than the first threshold, distinguishing the corresponding cluster as musical noise and extracting the cluster; and when the length of the cluster located on the designated voice-like frame is smaller than the second threshold, distinguishing the corresponding cluster as musical noise and extracting the cluster.

16. The method of claim 14, wherein the second threshold is larger than the first threshold.

17. The method of claim 10, wherein the second extracting comprises extracting the one or more second clusters corresponding to the musical noises by determining the similarities based on an average or deviation of cluster lengths for each of the residual clusters.

* * * * *